US009311835B2

(12) United States Patent
Breihof

(10) Patent No.: US 9,311,835 B2
(45) Date of Patent: Apr. 12, 2016

(54) LIGHTING MOUNT FOR INTERIOR-LIGHTED SIGNAGE AND METHOD OF RETROFITTING A LIGHTED SIGN

(75) Inventor: Thomas C. Breihof, Belmont, MI (US)

(73) Assignee: SignComp, LLC, Grand Rapids, MI (US)

( * ) Notice: Subject to any disclaimer, the term of this patent is extended or adjusted under 35 U.S.C. 154(b) by 1058 days.

(21) Appl. No.: 13/302,235

(22) Filed: Nov. 22, 2011

(65) Prior Publication Data

US 2012/0124874 A1 May 24, 2012

Related U.S. Application Data

(60) Provisional application No. 61/417,156, filed on Nov. 24, 2010.

(51) Int. Cl.
*F21V 1/00* (2006.01)
*G09F 13/04* (2006.01)

(52) U.S. Cl.
CPC ..... *G09F 13/04* (2013.01); *Y10T 29/49716* (2015.01)

(58) Field of Classification Search
CPC ..... F21Y 2103/00; F21S 4/003; F21S 4/008; G09F 13/00; G09F 9/33; F21W 2131/405; F21V 23/001; F21V 23/06; Y02B 20/386; Y10S 362/812
USPC ..... 362/217.02; 40/541
See application file for complete search history.

(56) References Cited

U.S. PATENT DOCUMENTS

| | | | | |
|---|---|---|---|---|
| 4,748,545 | A * | 5/1988 | Schmitt | 362/219 |
| 6,354,714 | B1 * | 3/2002 | Rhodes | 362/153.1 |
| 7,307,391 | B2 * | 12/2007 | Shan | 315/291 |
| 7,806,569 | B2 | 10/2010 | Sanroma et al. | |
| 7,926,977 | B2 | 4/2011 | Nall et al. | |
| 8,109,647 | B2 * | 2/2012 | Soo et al. | 362/217.03 |
| 8,115,411 | B2 * | 2/2012 | Shan | 315/294 |
| 8,118,447 | B2 * | 2/2012 | Simon et al. | 362/235 |
| 8,172,097 | B2 | 5/2012 | Nearman et al. | |
| 8,201,965 | B2 * | 6/2012 | Yamada et al. | 362/217.01 |
| 8,474,998 | B2 | 7/2013 | Wang et al. | |
| 8,523,394 | B2 * | 9/2013 | Simon et al. | 362/249.05 |
| 8,531,109 | B2 * | 9/2013 | Visser et al. | 315/88 |
| 8,674,626 | B2 * | 3/2014 | Siemiet et al. | 315/308 |

(Continued)

FOREIGN PATENT DOCUMENTS

JP 07121122 5/1995

*Primary Examiner* — William Carter
(74) *Attorney, Agent, or Firm* — Gardner, Linn, Burkhart & Flory, LLP

(57) ABSTRACT

A lamp support assembly, retrofit kit, and method are provided for lighting a sign from an interior thereof. The assembly can be used as a drop-in replacement for high-voltage gas-discharge tube lamps such as high-output fluorescent lamps, and may be used to retrofit signs originally built for gas-discharge tube lamps with low-voltage, high-efficiency lighting such as LED lighting. The assembly includes an elongate support member for supporting electric lamp units, with end caps at opposite ends of the support member for engaging the original electro-mechanical mounts (or replacement mounts) in the sign. Thus, the lamp support assembly can be supported in the sign in a similar manner as gas-discharge tube lamps, and can be powered by a low-voltage power source, which may replace a higher-voltage power source in the case of a retrofit.

20 Claims, 12 Drawing Sheets

(56) References Cited

U.S. PATENT DOCUMENTS

| | | | | |
|---|---|---|---|---|
| 2002/0126064 | A1 | 9/2002 | Yen | |
| 2007/0242466 | A1 | 10/2007 | Wu et al. | |
| 2008/0244944 | A1 | 10/2008 | Nall et al. | |
| 2009/0091929 | A1* | 4/2009 | Faubion | 362/234 |
| 2010/0165627 | A1 | 7/2010 | Wung et al. | |
| 2011/0019348 | A1 | 1/2011 | Kludt et al. | |
| 2011/0019413 | A1* | 1/2011 | Zimmerman et al. | 362/249.02 |
| 2011/0310598 | A1* | 12/2011 | Swafford, Jr. | 362/217.02 |
| 2012/0113628 | A1* | 5/2012 | Burrow et al. | 362/184 |

* cited by examiner

LIGHTING MOUNT FOR INTERIOR-LIGHTED SIGNAGE AND METHOD OF RETROFITTING A LIGHTED SIGN

CROSS REFERENCE TO RELATED APPLICATION

The present application claims the priority benefit of U.S. provisional application Ser. No. 61/417,156, filed Nov. 24, 2010, which is hereby incorporated herein by reference in its entirety.

FIELD OF THE INVENTION

The present invention relates to lighted signs and, more particularly, to electric lighting fixtures for internally-lit or back-lit signs.

BACKGROUND OF THE INVENTION

Internally-lighted or back-lit signs typically have a housing with one or more electric lighting fixtures for supporting and energizing gas-discharge electric lamps' (such as neon or fluorescent tube lamps), and associated electrical wiring to conduct electricity from the lighting fixtures to a power source. At least one side of the housing supports a display sheet (such as a rigid, semi-rigid, or flexible sheet made of cloth, paper, glass, polymer, or the like) that is at least partially translucent, the sheet including lettering, symbols, artwork, or the like. Light from the lamps inside the housing projects through the display sheet to illuminate the lettering or artwork on the sheet, for example.

SUMMARY OF THE INVENTION

The present invention provides a lighting mount that facilitates the retrofitting of existing interior-lit signs, which were originally manufactured for supporting and energizing gas-discharge lamps such as high-output fluorescent or neon tube lamps, with alternative lamps such as low-voltage LED lamps or the like. Optionally, the lighting mount of the present invention can be used in the production of new interior-lit signs that are equipped for low-voltage lighting, substantially without modifying the mechanical or structural features of the signs, which may have originally been designed to be internally lit by one or more higher-voltage fluorescent or neon tube lamps or the like.

In one form of the present invention, a lamp support assembly is provided for interior lighting of a sign. The lamp support assembly includes an elongate support member and a pair of end caps. The elongate support member is capable of supporting a plurality of electric lamp units, such as LED lamp units, between opposite end portions of the elongate support member. The end caps are attached to the elongate support member at opposite end portions thereof. Each of the end caps has an inwardly-facing side for engaging the respective opposite end portions of the elongate support member, and has an outwardly-facing side with a mechanical coupling element. The mechanical coupling element is configured to engage a standard mount such as a mount designed for supporting a gas-discharge lamp such as a fluorescent or neon tube lamp or the like. The elongate support member and the end caps are releasably supportable by and between a corresponding pair of the standard mounts when the standard mounts are supported in spaced arrangement on respective frame portions of the sign.

In another form of the present invention, a method is provided for retrofitting an internally-lighted sign that is fitted with one or more gas-discharge lamps or the like. The method includes the steps of: (i) removing the gas-discharge tube lamps from between corresponding pairs of electro-mechanical couplings that are positioned along an interior of the sign; (ii) cutting an elongate support member to fit between the respective pair or pairs of electro-mechanical couplings; (iii) positioning respective end caps at opposite end portions of the elongate support member; (iv) positioning one or more electric lamp units along the elongate support member; and (v) positioning the end caps, elongate support member, and electric lamp units between the pair of electro-mechanical couplings. The electric lamp units may be low-voltage lamp units, so that low-voltage wiring can be electrically connected to the lamp units and routed along the elongate support member to a low-voltage power source in electrical communication with the sign. Optionally, high voltage wiring, power sources, ballast, or the like, which had been associated with the gas-discharge tube lamps, can be removed and/or disabled. Optionally, the electro-mechanical couplings can be replaced with purely mechanical couplings that are structurally similar or identical to the electro-mechanical couplings being replaced.

Therefore, the present invention provides a lighting mount and method that facilitates the replacement of gas-discharge tube lamps in internally-lit signs with low-voltage lamps, such as LED lamps or the like. The lighting mount can be fitted between pairs of standard or conventional electro-mechanical couplings, such as couplings that were originally designed to support and energize gas-discharge tube lamps. In a typical retrofit installation, the lighting mount need not be electrically coupled to the electrical conductors of the electro-mechanical couplings, but instead could be only mechanically coupled, so that the electrical wiring, ballast, or other electrical components could be disabled and/or removed from the sign. Thus, high voltage and/or high power consumption lamps can be readily replaced with low voltage and/or low power consumption lamps in an existing internally-lit sign originally equipped or designed for gas-discharge lamps such as fluorescent or neon tube lamps, or in a newly-constructed internally lit sign that was originally designed for gas-discharge tube lamps, substantially without need for modifying the structure of the sign. The retrofitted or newly-constructed sign can thus be operated with lower energy and maintenance costs.

These and other objects, advantages, purposes and features of the present invention will become apparent upon review of the following specification in conjunction with the drawings.

DESCRIPTION OF THE PREFERRED EMBODIMENTS

Figure 1:
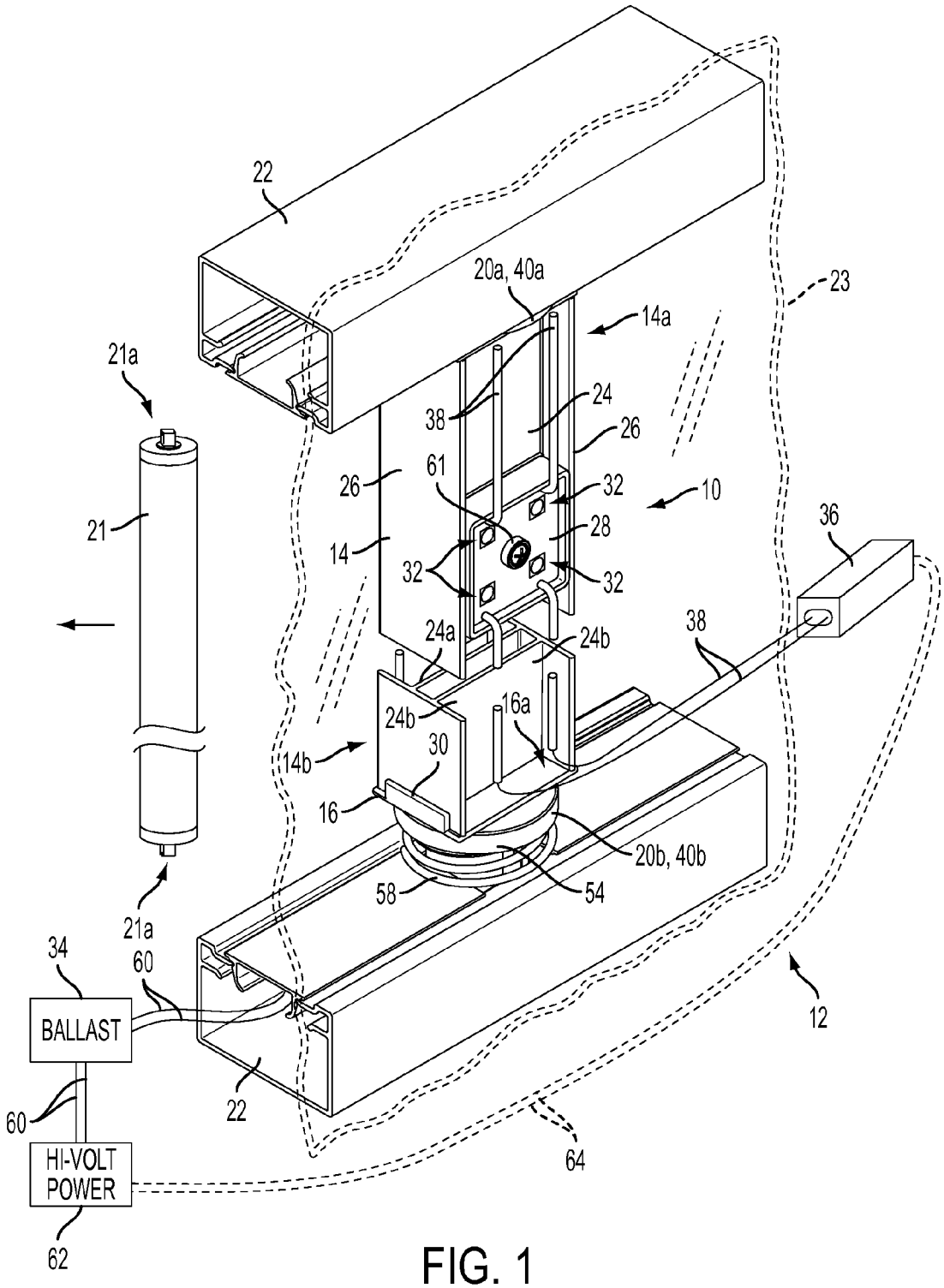
FIG. 1 is perspective view of a lighted sign assembly including a lamp support assembly in accordance with the present invention, and showing removal of a gas-discharge tube lamp.

Referring now to the drawings and the illustrative embodiments depicted therein, a lamp support assembly 10 is provided for interior lighting of a sign 12 (FIG. 1), which may be a single or double-sided sign (or a sign having substantially any number of sides or surfaces) that is internally-lit or "backlit". Lamp support assembly 10 allows for sign 12, which may have been originally designed and manufactured for internal lighting by one or more gas-discharge lamps such as fluorescent or neon tube lamps 21 or the like, to be retrofitted with alternative lighting, such as low-voltage lighting, largely or substantially without modifications to the original sign.

Figure 3:
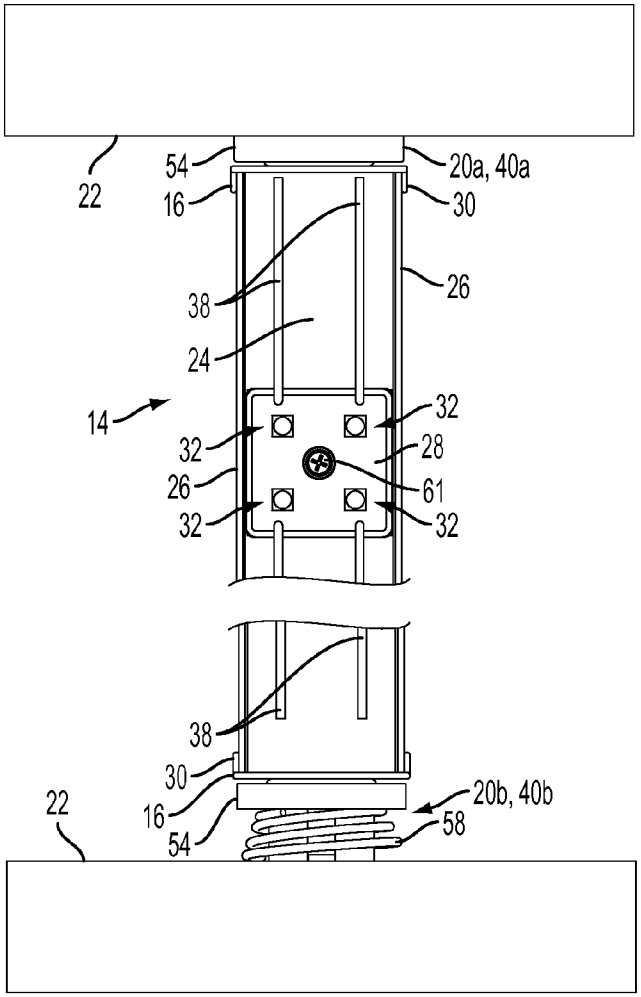
FIG. 3 is a front elevation of the lighted sign assembly of FIG. 1, and with the display sheet removed.

Lamp support assembly 10 includes an elongate support member 14 for supporting one or more electric lamp units 28 which, in the illustrated embodiment, each include four light emitting diode (LED) lamps 32 (FIGS. 1 and 3). Elongate support member 14 has opposite end portions 14*a*, 14*b*, and is sized to be positioned between generally parallel frame members 22 of sign 12. Each opposite end portion 14*a*, 14*b* of elongate support member 14 is fitted with an end cap 16. Each end cap 16 has an inwardly-facing side 16*a* and an outwardly-facing side 16*b*, such as shown in FIGS. 10-13. Inwardly-facing sides 16*a* are configured to engage one of the opposite end portions 14*a*, 14*b* of the elongate support member 14, while outwardly-facing sides 16*b* include a mechanical coupling element 18 for engaging one of two standard electro-mechanical mounts or sockets 20*a*, 20*b* that are configured for supporting and energizing fluorescent tube lamp 21, as will be described below. Optionally, purely-mechanical mounts or sockets 40*a*, 40*b* that are structurally similar or identical to standard mounts or sockets 20*a*, 20*b*, respectively, but which lack electrical conductors, may be provided in place of standard mounts or sockets 20*a*, 20*b*. Regardless of whether standard electro-mechanical mounts or purely-mechanical mounts are used (mounts 20*a*, 20*b* being substantially identical in appearance and structure to mounts 40*a*, 40*b*, respectively, as shown in FIGS. 1 and 3), lamp support assembly 10 is releasably supportable by and between the mounts 20*a*, 20*b* or 40*a*, 40*b* via releasable engagement of mechanical coupling elements 18 (FIGS. 4, 7, 10, 11, 13-15, 17, and 18), which are provided on the mounts 20*a*, 20*b* and 40*a*, 40*b*.

Sign 12 further includes a display sheet 23 that may be a rigid, semi-rigid, or flexible sheet material, which is supported by frame members 22 or by coupling elements (e.g. clips or other mechanical fasteners) or adhesives or the like, that are associated with the sign. For example, such sheet materials may be made of cloth, paper, glass, polymeric material, or the like. Display sheet 23 is at least partially translucent so that at least some of the light emitted from inside of the sign 12 can pass through the sheet 23 and can be seen by persons located within view of the sign. Optionally, the translucent portions of the display sheet 23 may be openings or apertures in the sheet. The display sheet may have substantially any lettering, symbols, artwork, coloring, indicia, or the like, which are made visible (or made more visible) when illuminated from behind (i.e., from inside of sign 12).

Figure 5:
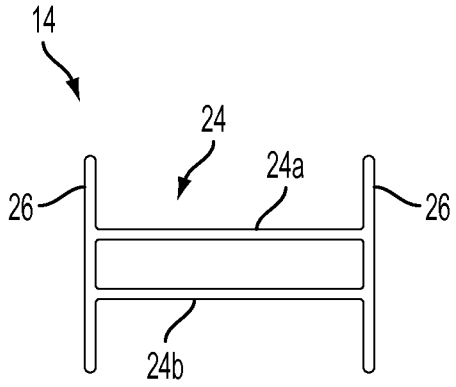
FIG. 5 is an end elevation of an elongate support member that is part of the lamp support assembly of FIG. 4.
Figure 6:
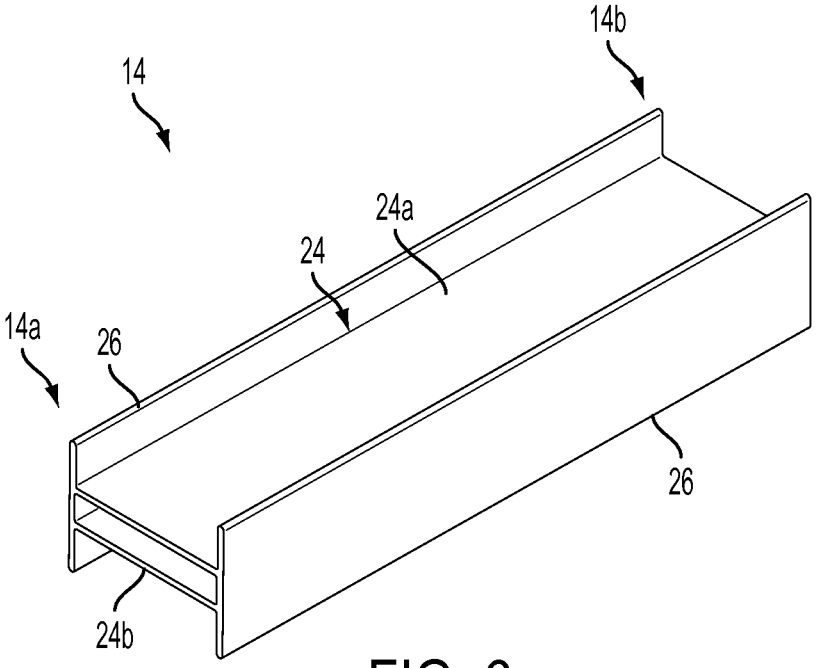
FIG. 6 is a perspective view of the elongate support member of FIG. 6.

Elongate support member 14 has an I-beam cross section with a double web portion 24 and flange portions 26 on opposite ends of the web portion 24 (FIGS. 1-4, 6, and 7). Web portion 24 comprises a pair of spaced plates 24*a*, 24*b* that are joined together by the flange portions 26, such as shown in FIGS. 5 and 6. Elongate support member 14 is configured to support the plurality of electric lamp units 28 along one or both opposite sides of web portion 24 (FIGS. 1-3), such as for lighting a one-sided sign or a two-sided sign, respectively.

Figure 7:
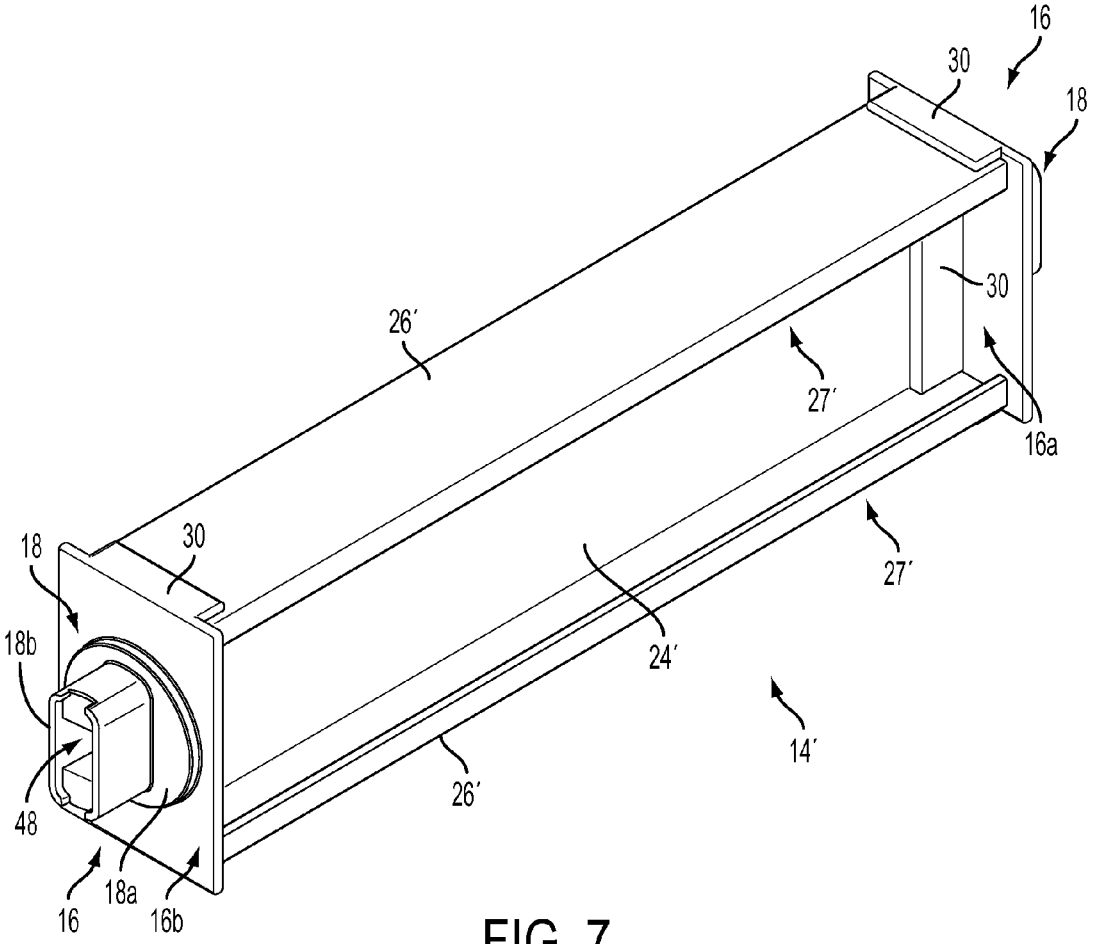
FIG. 7 is a perspective view of another lamp support assembly.
Figure 8:
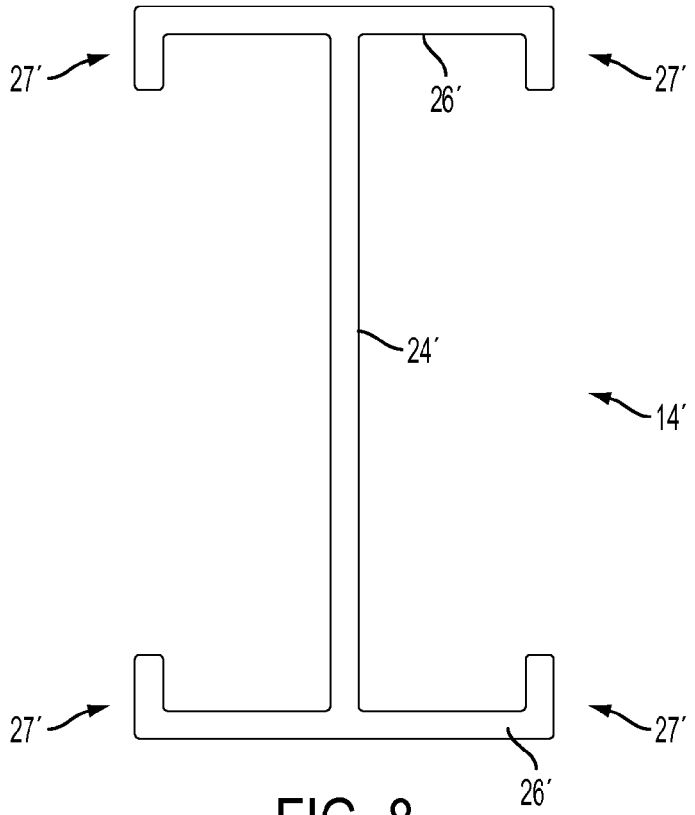
FIG. 8 is an end elevation of an elongate support member that is part of the lamp support assembly of FIG. 7.
Figure 9:
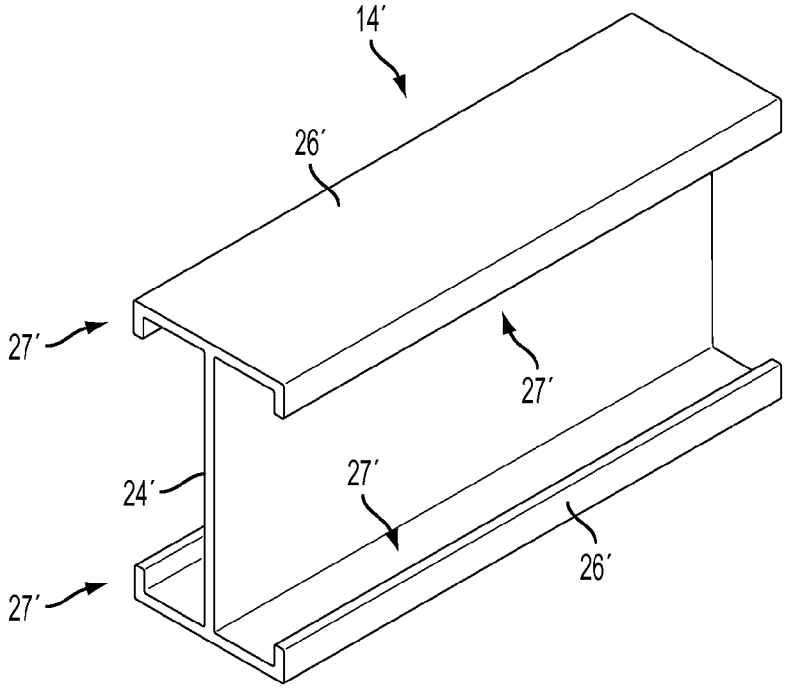
FIG. 9 is a perspective view of the elongate support member of FIG. 7.
Figure 10:
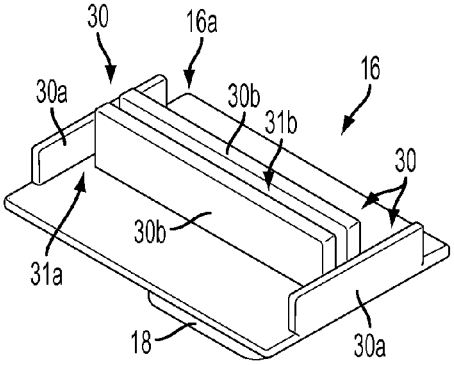
FIG. 10 is a perspective view of the inboard side of an end cap that is part of the lamp support assemblies of FIGS. 4 and 7.

Optionally, and with reference to FIGS. 7-9, an alternative support member 14' includes a web portion 24' that is comprised of a single plate with opposite flange portions 26'. Flange portions 26' include L-shaped flange tips 27' that may enhance the structural rigidity of support member 14', and that may provide a retaining function for electric lamp units that are positioned along the web portion 24', particularly if the L-shaped flange tips 27' along one side of web portion 24' are spaced more closely together than the width of electric lamp units 28 so that the lamp units can generally only be slid longitudinally along support member 14 until fixed in place, such as described below. Elongate support members 14, 14' may be extruded from metal or non-metal material, for example, such as aluminum or plastic, which may be readily cut using a saw or other cutting tool to obtain a finished length as desired.

The inwardly-facing sides 16*a* of end caps 16 include a plurality of wall-like projections 30 (FIGS. 1-4, 7, 10-12, 14, 15, 17, and 18) for engaging the I-beam cross section of the elongate support member 14 at the opposite ends 14*a*, 14*b* thereof, such as shown in FIGS. 1-4. Projections 30 include a pair of flange-engaging walls 30*a* on respective opposite ends of end cap 16, and a pair of web-engaging walls 30*b* that span substantially across inwardly-facing side 16*a* of end cap 16, between flange-engaging walls 30*a*. A flange-receiving gap 31*a* (FIGS. 12 and 14) is defined between each flange-engaging wall 30*a* and the nearby ends of web-engaging walls 30*b* for receiving the respective flange portions 26 or 26' of elongate support members 14 or 14'. A web-receiving gap 31*b* (FIGS. 10 and 12) is defined between the pair of web-engaging walls 30*b*, for receiving the single-wall web portion 24' of support member 14'. Web-engaging walls 30*b* are spaced such that their outwardly-facing surfaces (i.e., opposite the gap 31*b*) can frictionally engage the inner surfaces of the spaced plates 24*a*, 24*b* that form dual-wall web portion 24 of elongate support member 14. Thus, projections 30 are arranged to frictionally engage respective web and flange portions of either support member 14, 14', so that end caps 16 are at least frictionally retained at the opposite ends 14*a*, 14*b* of the elongate support member 14, 14'.

Mechanical coupling element 18, which is disposed along outwardly-facing side 16*b* of end cap 16 (FIGS. 4, 7, 10, 11, 13-15, 17, and 18), substantially replicates the structure of the conventional electro-mechanical end coupler 21*a* of a "high output" fluorescent tube lamp 21, and is shaped to engage or be received in the conventional or standard electro-mechanical sockets or mounts 20*a*, 20*b*. Standard electro-mechanical sockets or mounts 20*a*, 20*b* may be of the type commonly referred to as a "Kulka socket", such as that shown and described in U.S. Pat. No. 5,122,074, the disclosure of which is hereby incorporated herein by reference, and such as may be available as Part Nos. 582GDF and/or 583GDF from Voltarc Technologies, Inc. of Waterbury, Conn.

Figure 11:
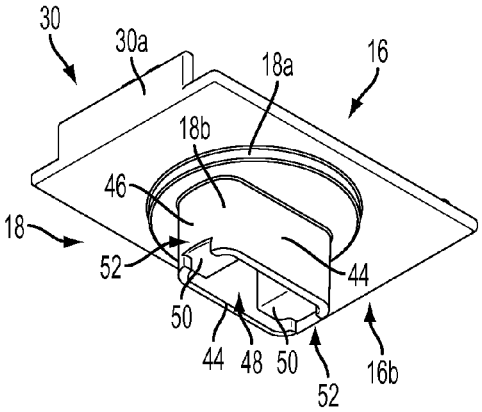
FIG. 11 is a perspective view of an outboard side of the end cap of FIG. 10.
Figure 12:
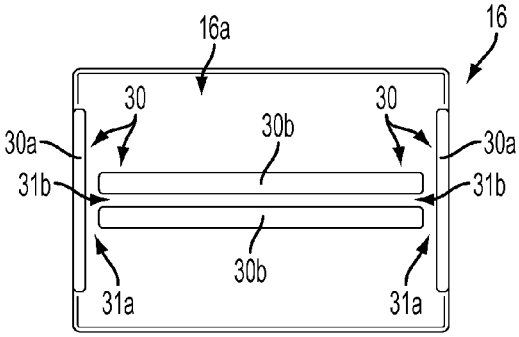
FIG. 12 is a plan view of the inboard side of the end cap of FIG. 10.
Figure 13:
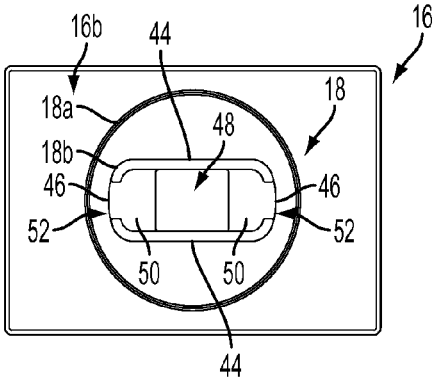
FIG. 13 is a plan view of the outboard side of the end cap of FIG. 10.
Figure 14:
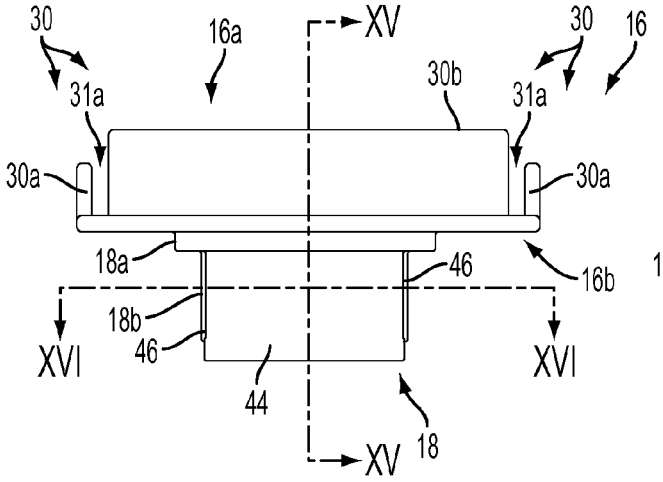
FIG. 14 is a front elevation of the end cap of FIG. 10.
Figure 15:
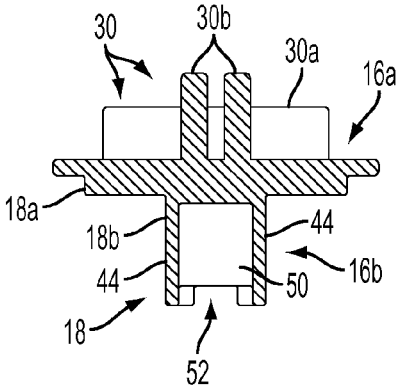
FIG. 15 is a sectional view of the end cap, taken along section line XV-XV of FIG. 14.
Figure 16:
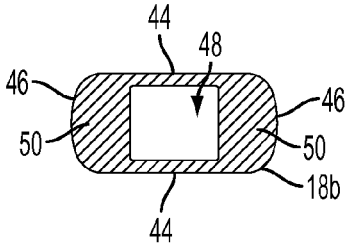
FIG. 16 is a sectional view of the end cap, taken along section line XVI-XVI of FIG. 14.
Figure 17:
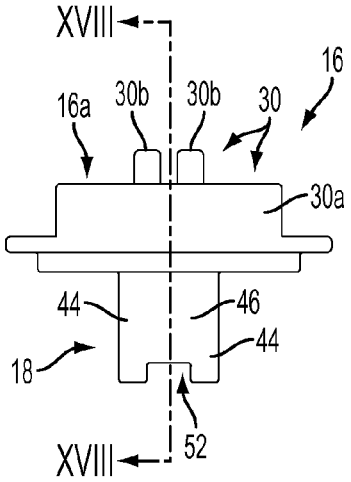
FIG. 17 is an end elevation of the end cap of FIG. 10.
Figure 18:
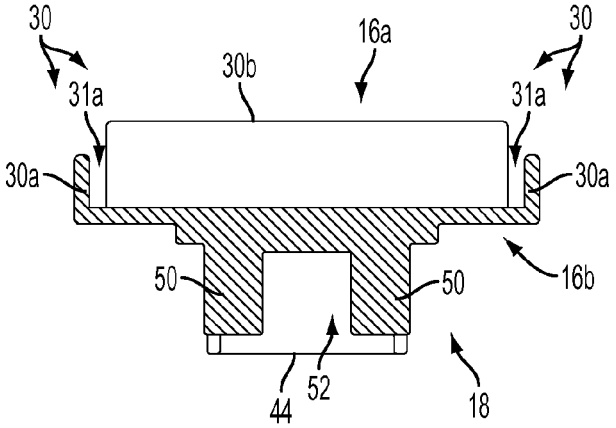
FIG. 18 is a sectional view of the end cap, taken along section line XVIII-XVIII of FIG. 17.
Figure 19:
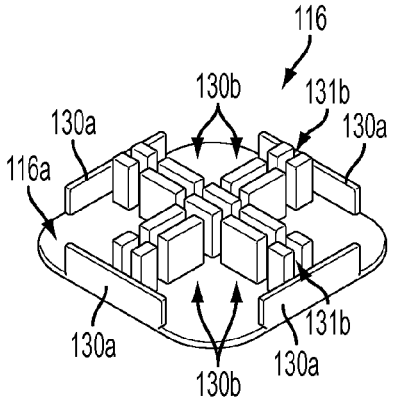
FIG. 19 is a perspective view of the inboard side of another end cap, which is compatible for use with the lamp support assemblies of FIGS. 4 and 7.
Figure 20:
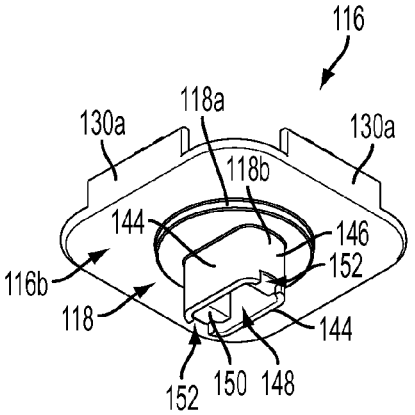
FIG. 20 is a plan view of the outboard side of the end cap of FIG. 19.

Mechanical coupling elements 18 include a base plate or flange 18*a* and a male prong or projection 18*b* extending outwardly from base plate 18*a* (FIGS. 4, 7, 10, 11, 13-15, 17, and 18). Male projection 18*b* has a pair of opposite side walls 44 that are spaced from each other and joined at their ends by rounded end walls 46 to define an interior cavity 48 (FIGS. 11 and 13). Inside of cavity 48 is a pair of recessed shoulders 50 that project outwardly from base plate 18*a*, but not as far as do side walls 44, and which form the outward extent of rounded end walls 46 so that a gap 52 is formed between end portions of the opposite side walls 44 (FIGS. 11, 13, 15, 17, and 18). Unlike the conventional electro-mechanical end couplers 21*a* of fluorescent tube lamp 21, however, mechanical coupling elements 18 lack electrical conductors since they need not be used to conduct electricity to electric lamp units 28. In all other respects, mechanical coupling elements 18 may be structurally very similar or even identical to the conventional electro-mechanical end couplers 21*a* of high output fluorescent tube lamps 21, which are configured to mechanically and electrically engage the standard electro-mechanical sockets or mounts 20*a*, 20*b* of sign 12 (FIG. 1). Mechanical coupling elements 18 may be made from injection-molded non-metal material, for example, such as a resinous plastic material or the like.

Optionally, it is envisioned that low-voltage wiring for lamp units 28 could be electrically coupled to electrical conductors mounted in the coupling elements 18 of the end caps 16 (i.e., to make coupling elements 18 substantially similar to the end couplers 21*a* of fluorescent tube lamps 21). This would allow each lamp support assembly 10 to be installed in the sign's original electro-mechanical mounts or sockets 20*a*, 20*b* along the respective frame members 22 and electrically coupled to a power source in substantially the same manner as the fluorescent tube lamps 21, as long as the power supplied to electro-mechanical mounts 20*a*, 20*b* is adjusted as appropriate for lamp units 28 (such as by cutting off the high voltage wiring 60 from ballast 34 and high-voltage power source 62, and instead supplying low voltage power to wiring 60 with low-voltage power source 36.

Figure 21A:
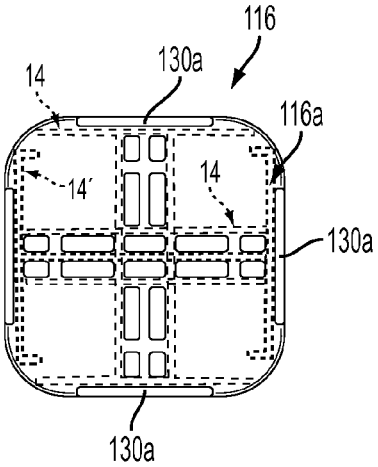
FIGS. 21A and 21B are perspective views of the inboard side of the end cap of FIG. 19, with FIG. 21A showing cross sections of the elongate support members of FIGS. 5 and 8 superimposed in phantom.
Figure 21B:
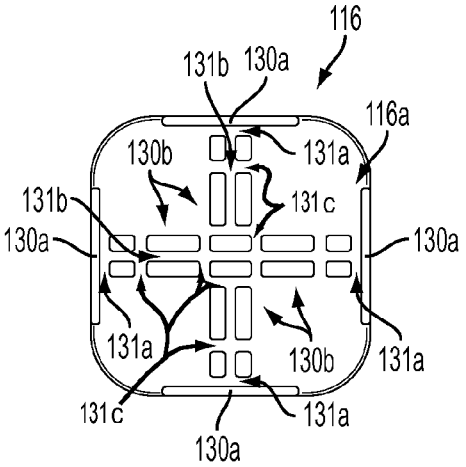
Figure 22:
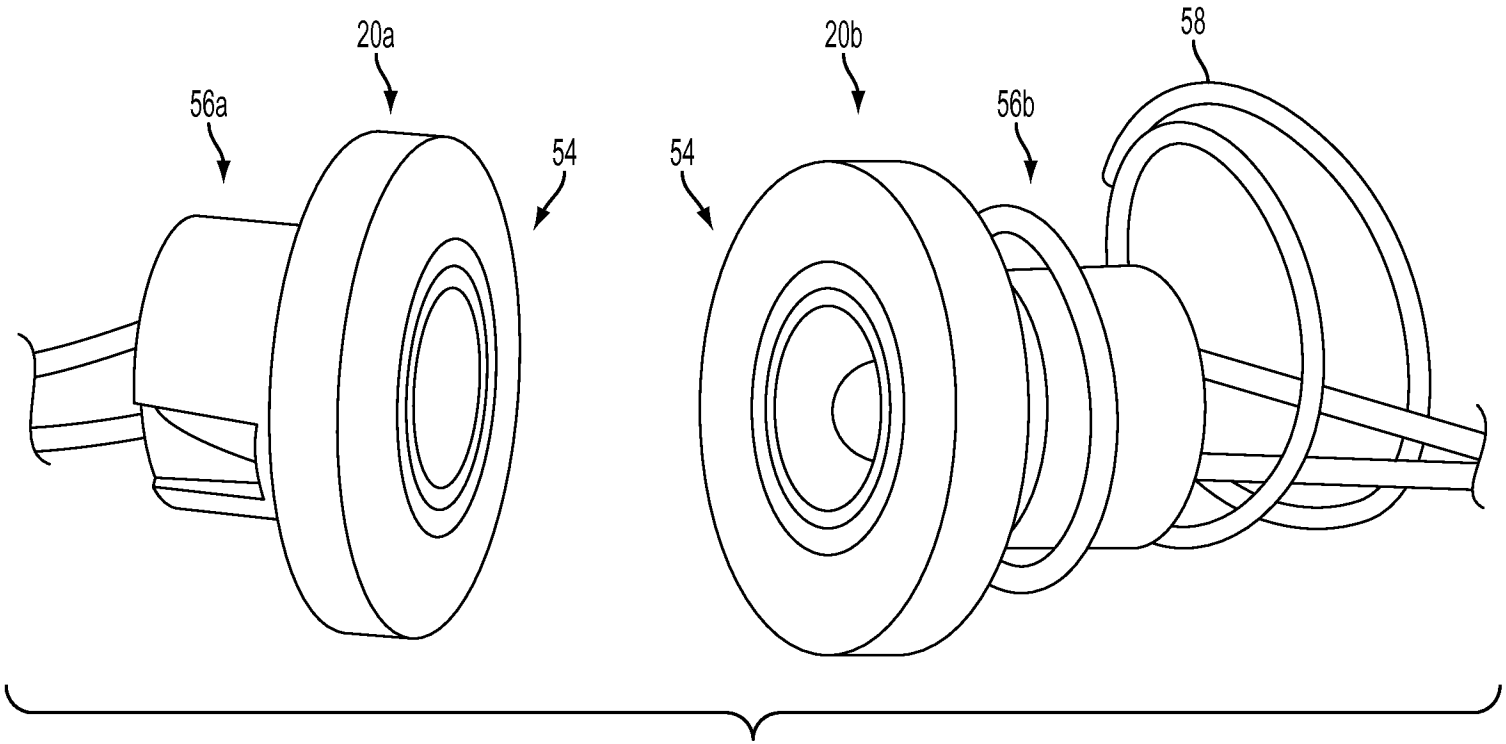
FIG. 22 is a perspective view of a pair of conventional socket mounts for supporting and energizing a gas-discharge tube lamp.

Optionally, and with reference to FIGS. 19-21B, an alternative end cap 116 has an inwardly-facing side 116*a* (FIGS. 19, 21A, and 21B) including a plurality of wall-like projections 130*a*, 130*b* for engaging the I-beam cross section of either of the elongate support members 14, 14', such as shown in FIG. 21A. An outwardly-facing side 116*b* of end cap 116 includes a mechanical coupling element 118 (FIG. 20) that is substantially identical to coupling element 18 of end cap 16, as described above. Wall-like projections 130*a*, 130*b* define flange-receiving gaps 131*a* and web-receiving gaps 131*b* (FIGS. 19 and 21B), which are substantially similar to gaps 31*a*, 31*b* between walls 30*a*, 30*b* of end cap 16, as described above. However, web-engaging walls 130*b* are discontinuous or segmented to define a pattern of gaps 131*c* along their respective lengths.

Gaps 131*c* permit inwardly-facing side 116*b* of end cap 116 to receive the dual-web elongate support member 14 in either of two orientations, such as shown in FIG. 21A, and/or to engage a dual-web elongate support member having shorter-length webs in which the flange portions would be received in gaps 131*c* that are spaced inwardly from flange-engaging walls 130*a* and flange-receiving gap 131*a*, while also remaining capable of receiving a single-web elongate support member such as support member 14', as shown. Thus, alternative end cap 116 can be mounted to different elongate support members in different orientations, which may facilitate directing light from lamp units 28 laterally toward the perimeter ends or sides of the sign, rather than directly outwardly through the display sheet 23, for example.

Figure 2:
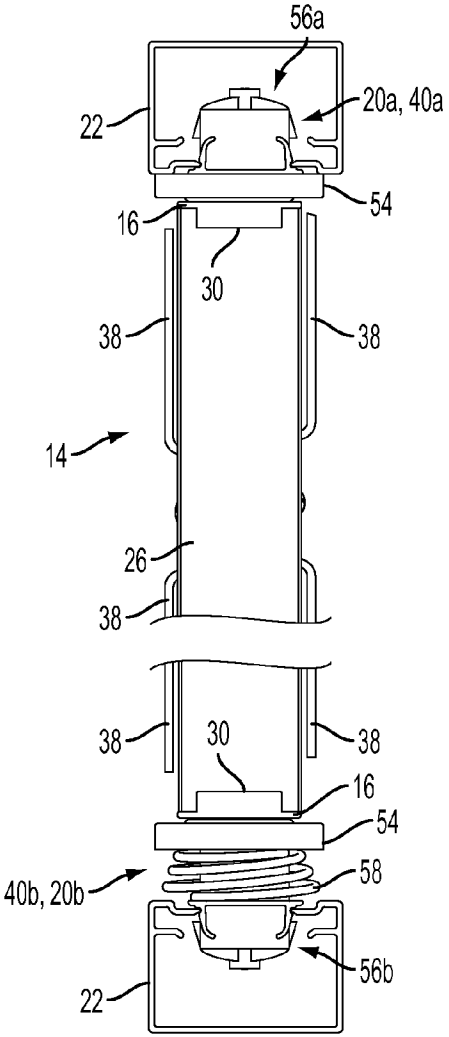
FIG. 2 is an end elevation of the lighted sign assembly of FIG. 1, and with the display sheet removed.
Figure 4:
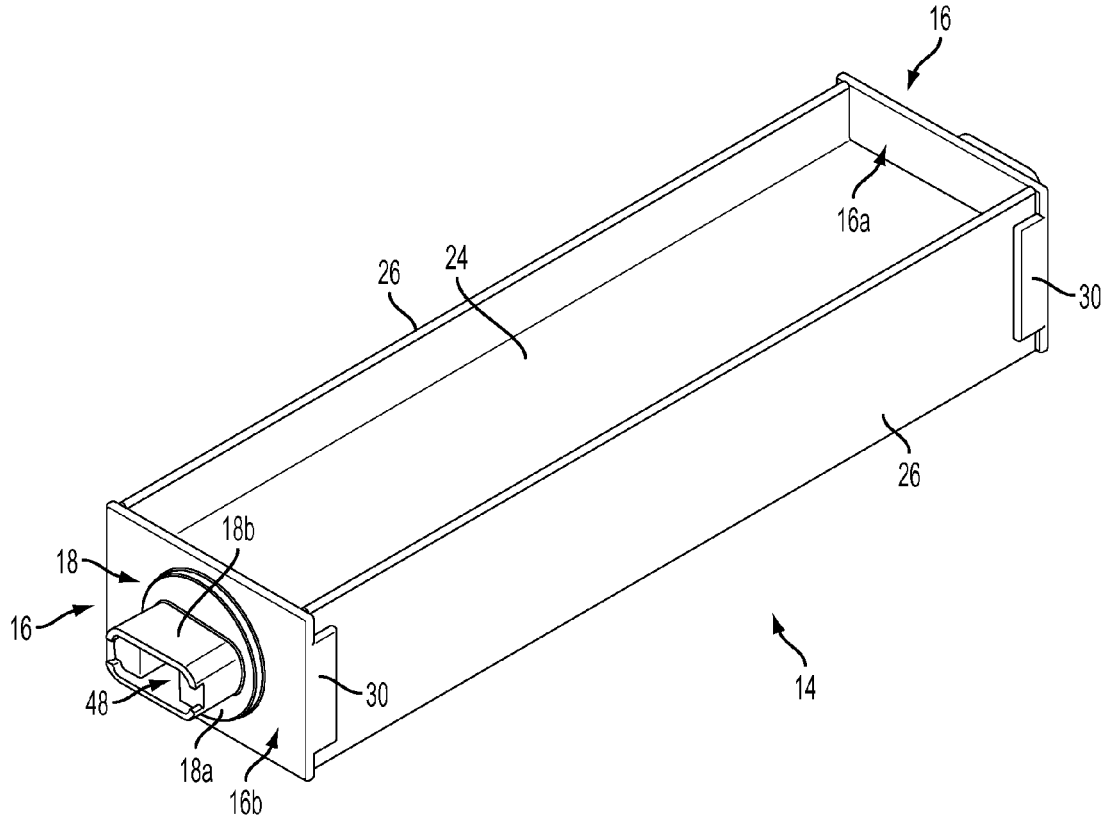
FIG. 4 is a perspective view of a lamp support assembly that is part of the lighted sign assembly of FIG. 1.

In the illustrated embodiment, electro-mechanical mount 20*a* is a fixed-position mount (such as Part No. 582GDF, available from Voltarc Technologies, Inc.) while electro-mechanical mount 20*b* is a spring-loaded mount (such as Part No. 583GDF, available from Voltarc Technologies, Inc.), such as shown in FIGS. 1-3 and 22. Mounts 20*a*, 20*b* include engaging portions or socket portions 54 for receiving conventional end couplers 21*a* of fluorescent tube lamps 21 (FIGS. 1-3), and respective mounting portions 56*a*, 56*b* (FIGS. 2 and 22) for engaging a frame portion, such as frame member 22. Mounting portion 56*b* of spring-loaded mount 20*b* includes a coil spring 58 (FIGS. 1-3 and 22) disposed around mounting portion 56*b* and held in compression between socket portion 54 and frame member 22 (FIGS. 1-3). This allows spring-loaded mount 20*b* to be somewhat extendable and retractable relative to frame member 22, while being biased outwardly from frame member 22 by spring 58 to hold fluorescent tube lamp 21 (or lamp support assembly 10) in place. As noted above, the purely-mechanical mounts or sockets 40*a*, 40*b* are structurally the same or substantially similar to standard mounts 20*a*, 20*b* including a fixed mechanical mount 40*a* and a spring-loaded mechanical mount 40*b*, and may be provided as optional replacements for electro-mechanical mounts 20*a*, 20*b*.

Optionally, an alternative standard or conventional electro-mechanical stand-off mount 20' (or a corresponding purely-mechanical mount, not shown) may be used (FIG. 23), which stands off from a mounting surface such as a frame member for supporting a fluorescent tube lamp (or lamp support assembly 10) substantially parallel to the mounting surface. Standard stand-off mounts 20' include a fixed-position stand-off mount 20*a'* (such as Part No. 530.2K, available from Voltarc Technologies, Inc.) and a spring-loaded stand-off mount 20*b'* (such as Part No. 530.1K, available from Voltarc Technologies, Inc.). Like mounts 20*a*, 20*b*, stand-off mounts

Figure 23:
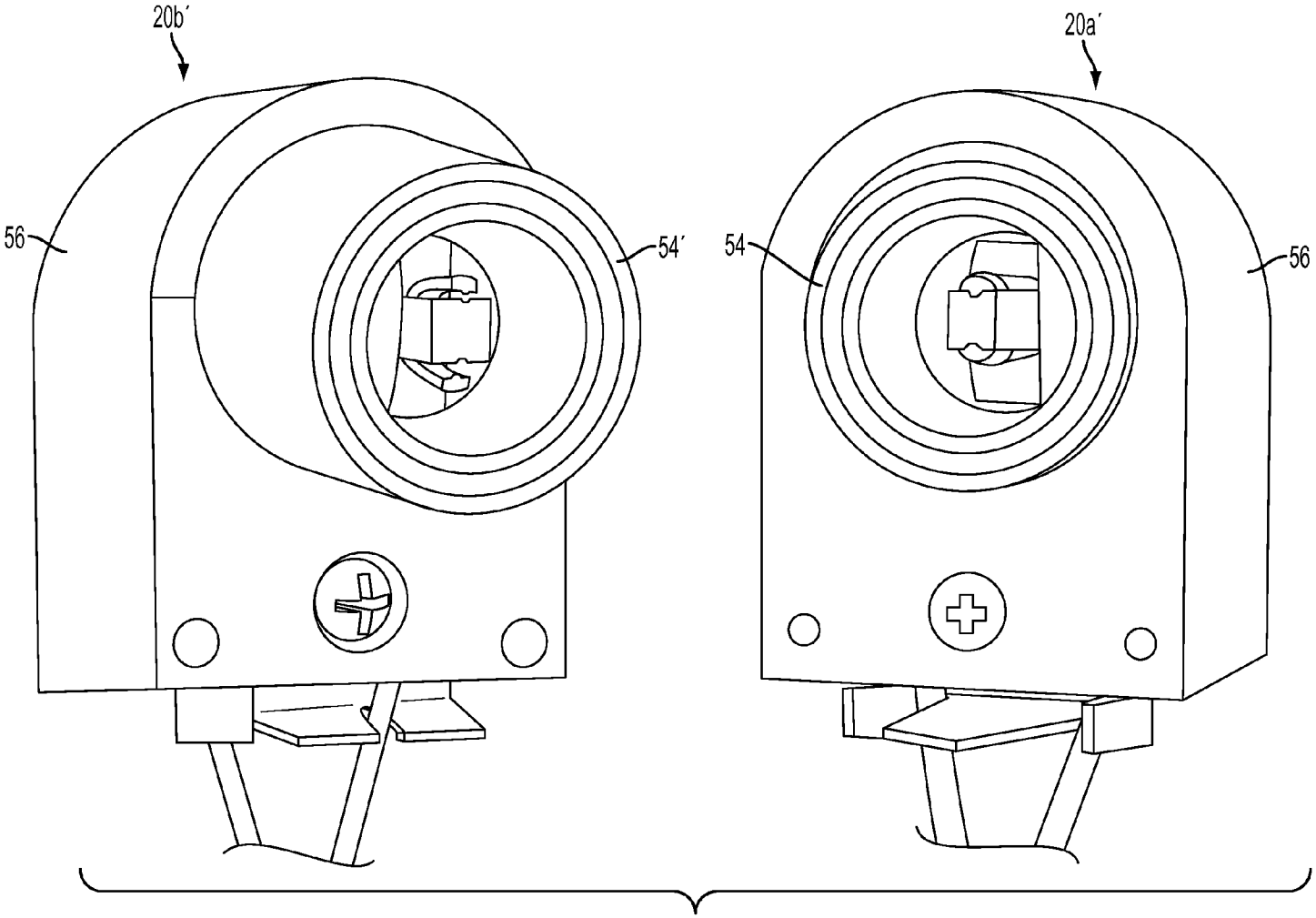
FIG. 23 is a perspective view of another pair of conventional socket mounts for supporting and energizing a gas-discharge tube lamp.

20*a*', 20*b*' each include a socket portion 54' and a mounting portion or housing 56', with an internal spring (not shown) disposed in the housing of spring-loaded stand-off mount 20*b*' to bias its socket portion 54' outwardly, such as shown in FIG. 23.

Figure 24:
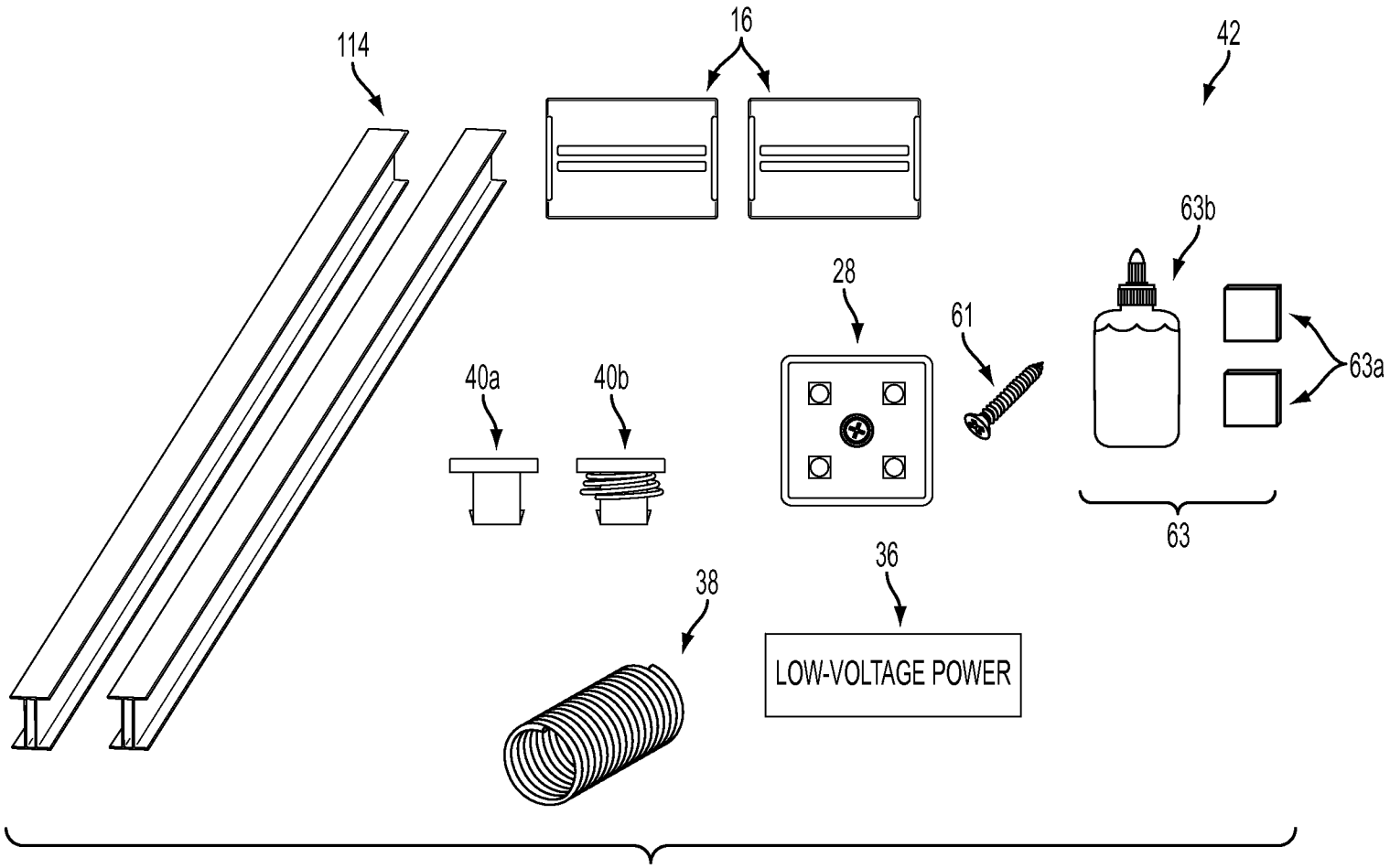
FIG. 24 is a plan view of a retrofit kit for use in converting a sign over from gas-discharge tube lamps to low-voltage lamp units.

Optionally, various components of the lamp support assemblies 10 can be provided in a retrofit kit 42 (FIG. 24). In the illustrated embodiment, retrofit kit 42 includes one or more elongate extrusions 114 and a pair of end caps 16 for each elongate support member 14 that will be formed from elongate extrusions 114. It will be appreciated that the term "elongate extrusion" is used for convenience, and that elongate support members 14 may be formed via any desired method, such as molding or machining or extruding or the like. Optionally, retrofit kit 42 may include one or more mechanical replacement mounts or sockets 40*a*, 40*b* that can be used to replace conventional or standard sockets, and the kit 42 may also include one or more electric lamp units 28, low-voltage wiring 38, a low-voltage power source or converter 36, mechanical fasteners 61, adhesives 63 (such as double-sided adhesive pads 63*a* or a chemical adhesive 63*b*), and/or the like.

Thus, lamp support assembly 10 can be positioned between standard electro-mechanical mounts 20*a*, 20*b*, or between purely-mechanical mounts or sockets 40*a*, 40*b*, by first engaging the mechanical coupling element 18 of the end cap 16 at end 14*b* of elongate support member 14 with the spring-loaded socket 20*b* or 40*b*, compressing the spring 58 to push mounting portion 56 (or a corresponding mounting portion of mechanical socket 40*b*) further into frame member 22, and then aligning the other mechanical coupling element 18 of the end cap at the opposite end 14*a* of elongate support member 14 with the fixed socket 20*a* or 40*a*, and releasing the assembly 10 so that spring 58 forces the mechanical coupling element 18 at the opposite end 14*a* of elongate support member 14 into engagement with the fixed socket 20*a* or 40*a*, thereby retaining lamp support assembly 10 between the respective sockets 20*a* or 40*a*, and 20*b* or 40*b*. Low-voltage wiring 38 may be electrically coupled to low-voltage power source 36 either before or after installation of lamp support assembly 10. It will be appreciated that lamp support assembly 10 can be removed simply by following the above steps in reverse order.

A method of retrofitting or assembling a sign to use alternative lamp units differs little from the procedure for installing and removing lamp support assembly 10, described above, although various optional steps may be added, as will now be described. Lamp support assembly 10 may be fabricated by cutting elongate support member 14, 14' to a desired length, fitting end caps 16 to the opposite ends 14*a*, 14*b* of elongate support member 14, 14', and installing electric lamp units 28 along one or both sides of web portion 24, 24' of elongate support member 14, 14'. Electrical lamp units 28 are typically installed along one or both sides of web portion 24, 24' of elongate support member 14, 14' using mechanical fasteners 61 (FIGS. 1 and 3), adhesives, or the like, prior to installation of the lamp support assembly 10 at the sign 12, although lamp units 28 can be added later, if desired. In the case of elongate support member 14' having flange portions 26' with L-shaped flange tips 27', the lamp units 28 may be inserted between L-shaped flange tips 27' and web portion 24' from either end of the elongate support member 14', such as in stacked or spaced arrangement, and held in place by L-shaped flange tips 27' and/or mechanical fasteners 61, adhesives, or the like. Low-voltage wiring 38 may be pre-installed at lamp units 28, or may be installed at lamp units 28 after they are attached to elongate support member 14, 14', and routed along elongate support member 14, 14'.

If the installation is a retrofit, fluorescent tube lamps 21 can be removed from sign 12 (FIG. 1) following the removal steps described above for lamp support assembly 10 (i.e. following the installation steps in reverse order), and lamp support assemblies 10 can then be installed between respective pairs of standard electro-mechanical mounting sockets 20*a*, 20*b* as described above. Optionally, standard electro-mechanical mounting sockets 20*a*, 20*b* can be replaced with purely mechanical replacement sockets 40*a*, 40*b* once fluorescent tube lamps 21 are removed. Otherwise, if the installation is in a new sign, the installer may choose whether to use standard electro-mechanical mounting sockets 20*a*, 20*b* or purely mechanical mounting sockets 40*a*, 40*b* at frame members 22.

Once lamp support assemblies 10 are installed, the low-voltage electrical wiring 38 is routed to a low-voltage electrical power source 36 (FIG. 1) so that the electric lamp units 28 can be supplied with the appropriate electrical power. Optionally, as in the case of a retrofit of a sign that had been previously set up or designed for fluorescent tube lamps 21, the installer may choose to cut, remove, or disable any high-voltage wiring 60 (FIG. 1) associated with the tube lamps 21 and ballast 34 and high-voltage power source 62. The installer may also choose to remove or disable the ballast 34, and may electrically couple low-voltage power source 36 to high voltage power source 62 via high-voltage wiring 64, which may be routed in an approved method, either externally to sign 12 or through frame members 22 (which may be hollow extruded sections, as shown in FIGS. 1 and 2). Depending on local or national electrical codes, it may be permissible to route low-voltage wiring 38 outside of conduits or frame members, which can simplify the installation process.

Therefore, the present invention provides a lighting mount assembly and method that facilitates the retrofitting of existing interior-lit signs, which may have been originally manufactured for supporting and energizing high-output gas-discharge lamps, such as fluorescent or neon tube lamps or the like. The signs may be retrofitted with alternative lamps such as low-voltage LED lamps or the like, although it will be appreciated that principles of the present invention can be practiced in connection with substantially any type of lighting as an alternative to gas-discharge lamps such as fluorescent tube lamps. The lighting mount assembly can also be used in the production of new interior-lit signs that are equipped for low-voltage lighting, substantially without modifying the mechanical or structural features of the signs, which may have originally been designed to be internally lit by one or more fluorescent tube lamps or the like.

Changes and modifications in the specifically described embodiments can be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A lamp support assembly for interior lighting of a sign, said lamp support assembly comprising:

an elongate support member for supporting a plurality of electric lamp units, said elongate support member having opposite end portions;

one and only one end cap at each of said opposite end portions of said elongate support member, each of said end caps having an inwardly-facing side and an outwardly-facing side, said inwardly-facing sides configured to frictionally engage and be supported at a respective one of said opposite end portions of said elongate support member;

a mechanical coupling element at each of said outwardly-facing sides of said end caps, said mechanical coupling element configured to engage a single electro-mechanical mount for a gas-discharge lamp, wherein said mechanical coupling element comprises electrically insulative material and does not retain any electrical conductors along or through said mechanical coupling element for powering the plurality of electric lamp units; and wherein said elongate support member and said end caps are releasably supportable by and between two and only two of the mounts when the two mounts are aligned directly opposite one another and supported in spaced arrangement on respective frame portions of the sign.

2. The lamp support assembly of claim 1, wherein said elongate support member comprises an I-beam cross section having a web portion and spaced-apart flange portions on opposite ends of said web portion.

3. The lamp support assembly of claim 2, wherein said web portion of said elongate support member comprises a pair of spaced plates joined together by said flange portions.

4. The lamp support assembly of claim 2, wherein said inwardly-facing sides of said end caps comprise a plurality of projections for engaging said I-beam cross section of said elongate support member at said opposite ends thereof.

5. The lamp support assembly of claim 4, wherein said inwardly-facing sides of said end caps are configured to engage either of (i) a single-web I-beam cross section or (ii) a dual-web I-beam cross section of said elongate support member.

6. The lamp support assembly of claim 2, wherein said elongate support member is configured to support the plurality of electric lamp units at said web portion.

7. The lamp support assembly of claim 6, wherein said elongate support member is configured to support the electric lamp units along opposite sides of said web portion.

8. The lamp support assembly of claim 1, wherein said mechanical coupling elements are configured to engage a fixed-position mount and a spring-loaded mount, each of the mounts being configured for supporting a respective opposite end portion or coupler of a gas-discharge lamp and for supplying electricity to the gas-discharge lamp.

9. The lamp support assembly of claim 1, further in combination with a lighted sign and a plurality of the electric lamp units.

10. The lamp support assembly of claim 9, wherein said electric lamp units comprise LED lamps.

11. The lamp support assembly of claim 10, wherein said elongate support member comprises an I-beam cross section having a web portion and spaced-apart flange portions on opposite ends of said web portion, and wherein said electric lamp units are coupled to said web portion and are positioned between said spaced-apart flange portions.

12. The lamp support assembly of claim 1, wherein said elongate support member comprises a metal or a resinous plastic extrusion, and wherein said end caps comprise a non-metal material.

13. A method of retrofitting an internally-lighted sign that is fitted with one or more gas-discharge lamps, said method comprising:

removing the one or more gas-discharge lamps from between one or more respective pairs of gas-discharge lamp couplings positioned directly opposite from one another along an interior of the sign;

positioning and frictionally engaging respective end caps at opposite end portions of an elongate support member, wherein the end caps are made of electrically insulative material and do not retain any electrical conductors along or through said end caps for powering said plurality of electric lamp units;

positioning one or more electric lamp units along the elongate support member; and engaging each of the end caps in a non-conductive manner with a respective one and only one of the gas-discharge couplings or with a respective one and only one replacement coupling to thereby position the end caps, the elongate support member, and the electric lamp units between the gas-discharge lamp couplings or replacement couplings that are positioned directly opposite from one another.

14. The method of claim 13, further comprising cutting the elongate support member to fit between the one or more respective pairs of the gas-discharge lamp couplings or the replacement couplings.

15. The method of claim 13, further comprising disabling or removing an existing ballast in the internally-lighted sign so that the gas-discharge lamp couplings cannot readily be electrically energized.

16. The method of claim 13, further comprising:

providing a low-voltage power source for energizing the electric lamp units; and electrically coupling the electric lamp units to the low-voltage power source.

17. The method of claim 16, wherein said positioning one or more electric lamp units along the elongate support member further comprises routing low-voltage electrical wiring associated with the electric lamp units along at least a portion of the elongate support member and electrically connecting the electrical wiring to the low voltage power source.

18. The method of claim 13, further comprising replacing the gas-discharge lamp couplings with purely mechanical replacement couplings prior to said positioning the end caps, elongate support member, and electric lamp units.

19. A retrofit kit for an internally-lit sign, the sign having a framework and at least one display sheet that is at least partially translucent, said kit comprising:

an elongate support member for supporting a plurality of electric lamp units, said elongate support member having opposite end portions;

a plurality of low-voltage lamp units for positioning along the elongate support member;

a pair of end caps configured to frictionally engage the opposite end portions of the elongate support member, each of the end caps having one and only one mechanical coupling element at an outwardly-facing side thereof, wherein the end caps are made of electrically insulative material and do not retain any electrical conductors along or through said mechanical coupling element for powering said plurality of electric lamp units; and wherein respective mechanical coupling elements of the pair of end caps are configured to non-electrically engage respective individual standard mounts located directly opposite one another at the framework that are for supporting a single gas-discharge lamp at the framework.

20. The retrofit kit of claim 19, further comprising a pair of purely mechanical mounts for replacing the standard mounts in the sign.

* * * * *